US009702675B2

(12) United States Patent
Pettersson

(10) Patent No.: US 9,702,675 B2
(45) Date of Patent: Jul. 11, 2017

(54) BRAKE PANEL FOR A DETONATOR OR A PROJECTILE

(71) Applicant: BAE Systems Bofors AB, Karlskoga (SE)

(72) Inventor: Thomas Pettersson, Karlskoga (SE)

(73) Assignee: BAE SYSTEMS BOFORS AB, Karlskoga (SE)

( * ) Notice: Subject to any disclaimer, the term of this patent is extended or adjusted under 35 U.S.C. 154(b) by 31 days.

(21) Appl. No.: 14/375,997

(22) PCT Filed: Jan. 28, 2013

(86) PCT No.: PCT/SE2013/000011
§ 371 (c)(1),
(2) Date: Jul. 31, 2014

(87) PCT Pub. No.: WO2013/119163
PCT Pub. Date: Aug. 15, 2013

(65) Prior Publication Data

US 2015/0001335 A1 Jan. 1, 2015

(30) Foreign Application Priority Data

Feb. 6, 2012 (SE) ..... 1230014

(51) Int. Cl.
*F42B 10/50* (2006.01)
*F42C 19/02* (2006.01)
(Continued)

(52) U.S. Cl.
CPC ..... *F42B 10/50* (2013.01); *F42C 19/02* (2013.01)

(58) Field of Classification Search
CPC ..... F42B 10/32; F42B 10/48; F42B 10/50; F42B 10/02; F42B 10/14; F42B 10/26;
(Continued)

(56) References Cited

U.S. PATENT DOCUMENTS 1,181,203 A * 5/1916 Alard ..... F42B 10/50 244/3.21
3,188,958 A 6/1965 Burke et al.
(Continued)

FOREIGN PATENT DOCUMENTS

| | | | |
|---|---|---|---|
| DE | 100 05 414 | A1 | 8/2001 |
| FR | 496 912 | A | 11/1919 |
| WO | WO-0214781 | A1 | 2/2002 |

OTHER PUBLICATIONS

Supplementary European Search Report issued Aug. 6, 2015 in EP Appln No. 13746181.

*Primary Examiner* — Bernarr Gregory
(74) *Attorney, Agent, or Firm* — Polsinelli PC

(57) ABSTRACT

The invention relates to a brake panel (3, 3') for a projectile (1), in which those surfaces (A) of the brake panel (3, 3') which are facing in the direction of travel of the projectile are wholly or partially angled in such a way that the normal from the said surfaces (A) is not parallel with the center line (C) of the projectile (1) in order to reduce or counteract the Magnus torque generated during and after the extension of the brake panel (3, 3'). The invention further relates to a detonator (2) for a projectile (1) and a projectile (1) comprising such a brake panel.

12 Claims, 2 Drawing Sheets

(51) Int. Cl.
*F42B 10/00* (2006.01)
*F42C 19/00* (2006.01)

(58) Field of Classification Search
CPC ..... F42B 10/28; F42B 10/30; F42B 10/38; F42B 10/60; F42B 10/62; F42B 10/64; F42C 19/00; F42C 19/02; B64G 1/22; B64G 1/62; F41G 7/34; F41G 7/346
USPC ..... 102/382, 386, 388, 335, 347, 348, 384, 102/400, 293; 244/3.1, 3.21–3.3, 3.15
See application file for complete search history.

(56) References Cited

U.S. PATENT DOCUMENTS 3,643,599 A * 2/1972 Hubich ..... F42B 10/14 102/388
3,690,596 A * 9/1972 Durran ..... F42B 10/30 244/3.21
4,029,270 A * 6/1977 Niemeier ..... F42B 10/30 244/3.21
4,502,649 A * 3/1985 Botwin ..... F42B 10/38 244/3.1
4,560,121 A * 12/1985 Terp ..... F42B 10/64 244/3.28
4,624,424 A * 11/1986 Pinson ..... F42B 10/64 102/384
4,699,333 A * 10/1987 Pinson ..... F42B 10/64 244/3.28
5,088,414 A * 2/1992 Vesa ..... F42B 10/50 102/388
5,155,294 A * 10/1992 Vesa ..... F42B 10/50 102/384
5,233,126 A * 8/1993 Vogt ..... F42B 10/50 102/386
5,237,925 A * 8/1993 Vogt ..... F42B 10/50 102/386
5,277,116 A * 1/1994 Axinger ..... F42B 10/50 102/388
5,280,752 A * 1/1994 Borgstrom ..... F42B 10/50 102/384
5,282,422 A * 2/1994 Borgstrom ..... F42B 10/50 102/384
5,282,588 A * 2/1994 August ..... F42B 10/64 244/3.27
5,826,821 A * 10/1998 Brandon ..... F42B 10/50 102/293
6,307,514 B1 * 10/2001 West ..... F41G 7/346 102/384
6,310,335 B1 * 10/2001 Bonnet ..... F42B 10/50 244/3.1
6,325,325 B1 * 12/2001 Bonnet ..... F42B 10/50 244/113
6,502,785 B1 * 1/2003 Teter ..... F42B 10/64 244/3.22
6,511,016 B2 * 1/2003 Bar ..... F42B 10/50 244/113
6,672,536 B2 * 1/2004 Bar ..... F42B 10/50 244/3.23
7,004,424 B1 * 2/2006 Pacchia ..... F42B 10/50 102/348
7,163,176 B1 * 1/2007 Geswender ..... F42B 10/64 102/400
7,229,048 B1 * 6/2007 August ..... B64G 1/62 244/3.27
7,347,147 B2 * 3/2008 Bar ..... F42B 10/50 244/3.27
8,026,465 B1 * 9/2011 Fraysse, Jr. ..... F42B 10/50 244/3.22
2001/0039898 A1 11/2001 Bar et al.
2003/0037665 A1 2/2003 Rupert et al.
2003/0042356 A1 3/2003 Bar et al.
2005/0258308 A1 11/2005 Bar et al.

* cited by examiner

BRAKE PANEL FOR A DETONATOR OR A PROJECTILE

CROSS REFERENCE TO RELATED APPLICATIONS

This application is a National Phase filing under 35 U.S.C. §371 of PCT/SE2013/000011 filed on Jan. 28, 2013; and this application claims priority to Application No. 1230014-1 filed in Sweden on Feb. 6, 2012 under 35 U.S.C. §119; the entire contents of each application is hereby incorporated by reference.

TECHNICAL FIELD

The present invention relates to one or more brake panels for a projectile, which projectile is designed for firing from a launcher. The projectile comprises one or more extensible brake panels, which, when extended, brake the velocity of the projectile in the trajectory of the projectile. In addition, the invention is constituted by a detonator intended for projectiles, which detonator comprises one or more brake panels for braking the velocity of the projectile in the trajectory of the projectile. The invention further relates to a projectile comprising one or more brake panels for braking the velocity of the projectile in the trajectory of the projectile.

BACKGROUND OF THE INVENTION, PROBLEM DEFINITION AND PRIOR ART

The precision at the target for barrel-launched projectiles, for example projectiles for artillery, is dependent on a number of factors, such as, for example, meteorological aspects, the exactness of the launcher, and the launch velocity of the projectile, also referred to as V0. Traditionally the accuracy, viewed from the launcher, with regard to deviation in angle is good compared with the deviation in distance. By improving the deviation in distance, it is possible to improve the overall accuracy and precision for the projectile, which increases the prospects of effectively combating the target for which the projectile is intended.

As a result of the braking effect, the precision in distance of the projectile, also referred to as the longitudinal direction, can be improved. At launch the range of fire can be beyond the target and, during the trajectory of the projectile, the braking effect generated by the brake can adapt the range of fire so as to hit the target. The brake, and the braking effect generated by the brake, result in the enablement of guidance in the longitudinal direction. Guidance in the lateral direction is previously known with, for example, customized control members such as fins. Braking is effected with brake panels, which can be constituted by brake panels, brake flaps or fins designed for braking.

EP-1045221-A1 describes an invention which shows an air brake for a projectile having flat extensible panels. When extended, the panels shown in the description create a flat surface against the direction of travel of the projectile so as to create maximum air resistance, based on the size of the panel, and thus high braking effect.

U.S. Pat. No. 4,072,107 describes an invention which discloses a projectile/sub-munition in the form of a missile with adjustable fins designed to both reduce and increase rotation, as well as to brake the missile. The braking system which is shown in the description uses wholly flatly arranged fins to create maximum air resistance and thus high braking effect.

A problem with the said embodiments of a projectile brake is that, when the brake panel/fin is extended, then the extending and extended brake panel/fin produces a Magnus effect, which produces a force which interferes with the projectile and the projectile brake. The Magnus effect is a force which acts on moving and rotating bodies, such as a projectile flying through the air, and is directed at right angles to the direction of travel. When a brake panel is extended, the Magnus effect produces a Magnus torque which affects the trajectory of the projectile.

Further problems which the invention aims to solve emerge in connection with the following detailed description of the different embodiments.

OBJECT OF THE INVENTION AND ITS DISTINGUISHING FEATURES

By changing the configuration of the top side of the brake panel, that is to say the side which is in the direction of travel of the projectile, the Magnus torque can be counteracted, minimized and/or reduced during the extension, as well as after the brake panel has been extended.

The invention is constituted by a brake panel for a projectile, which projectile is designed for firing from a launcher, in which those surfaces of the brake panel which are facing in the direction of travel of the projectile are wholly or partially angled in such a way that the normal from the said surfaces is not parallel with the centre line of the projectile in order to reduce or counteract the Magnus torque generated during the extension of the brake panel and after the extension of the brake panel.

According to further aspects of the improved brake panel according to the invention:

the rear side of the brake panel, situated opposite to the direction of travel of the projectile, is flatly configured with a normal from the surface having the same angulation as the centre line of the projectile;

the brake panel is obliquely arranged in the projectile, and the rear side of the said brake panel, which is situated opposite to the direction of travel of the projectile, is angled like the front side of the said brake panel facing in the direction of travel of the projectile;

the angulation of the normal from that surface of the brake panel which is facing in the direction of travel is in the order of magnitude of 1 degree relative to the centre line of the projectile;

the angulation of those surfaces of the brake panel which are facing in the direction of travel of the projectile is variably adjustable relative to the centre line of the projectile in order to reduce or counteract the Magnus torque generated upon the extension of the brake panel.

In addition, the invention is constituted by a detonator for a projectile comprising one or more extensible brake panels, in which those surfaces of the brake panels which are facing in the direction of travel of the projectile are wholly or partially angled relative to the centre line of the projectile in order to reduce or counteract the Magnus torque generated upon the extension of the brake panels and after the extension of the brake panels.

The invention is further constituted by a projectile designed for firing from a launcher, which projectile comprises one or more extensible brake panels, in which those surfaces of the brake panels which are facing in the direction of travel of the projectile are wholly or partially angled relative to the centre line of the projectile in order to reduce or counteract the Magnus torque generated upon the extension of the brake panels and after the extension of the brake panels.

According to further aspects of the improved projectile according to the invention:

the number of brake panels is two or four or six or eight;

the number of brake panels is one or three or five or seven;

the angulation of the individual brake panels is configured such that the rotation force created on the brake panels upon the propulsion of the projectile leaves the rotation of the projectile unaffected;

the angulation of all of the brake panels is configured such that the rotation force created on the brake panels upon the propulsion of the projectile increases the rotation of the projectile;

the angulation of all of the brake panels is configured such that the rotation force created on the brake panels upon the propulsion of the projectile reduces the rotation of the projectile;

the brake panel is variably adjustable between the fully extended state and the wholly retracted state.

ADVANTAGES AND EFFECTS OF THE INVENTION

The invention shows that, if those surfaces or sides of the brake panels which are facing in the direction of travel of the projectile are angled relative to the centre line of the projectile, the Magnus torque generated upon the extension of the brake panels is counteracted, minimized and/or reduced, which results in a reduction of the disturbing forces acting on the projectile and thus a reduction of deviations in the trajectory of the projectile. The precision for projectiles provided with brakes is thereby improved.

LIST OF FIGURES

The invention will be described in greater detail below with reference to the appended figures, in which.

DETAILED DESCRIPTION OF EMBODIMENTS

Figure 1:
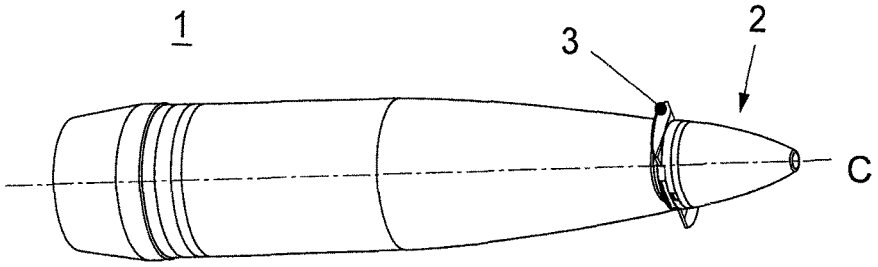
FIG. 1 shows a projectile provided with a detonator comprising extended brake panels according to the invention.

In FIG. 1 is shown a projectile 1, intended for artillery, having a detonator 2, in which the detonator can be mounted as a separate unit on the projectile or configured as a part of the projectile 1. In the shown embodiment, the projectile 1 is braked by brake panels 3 extended from the projectile 1. The projectile 1 is rotationally symmetrical about a centre line C shown in the figure.

Figure 2:
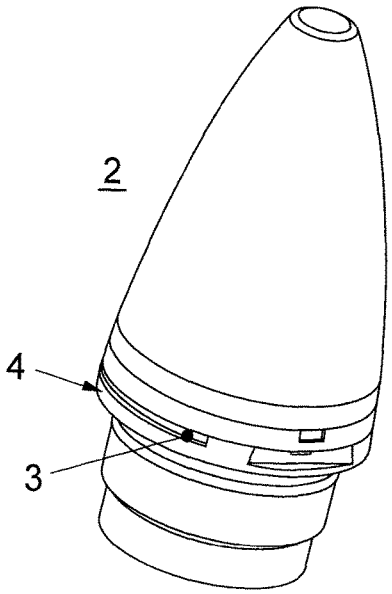
FIG. 2 shows a detonator in a first embodiment with chamfered brake panels in the retracted state according to the invention.

In FIG. 2, a detonator 2 is shown prior to extension of obliquely bevelled brake panels 3. The activation and extension of the brake panel can be effected by a mechanical, electromechanical, chemical or pyrotechnic device. Should the brake panels 3 be obliquely bevelled, the top side of the brake panel, that is to say the surface A facing in the direction of travel, is chamfered or otherwise machined in order to obtain a surface inclined in the direction of travel, that is to say a surface the angulation of whose normal deviates from the centre line C of the projectile. The inclination is commonly in the order of magnitude of 1-5 degrees, but greater angulation can also be found. It is preferably that the inclination is between 0.1 degree to 10 degree of the normal from surfaces A compared to the centre line C of the projectile.

Figure 3:
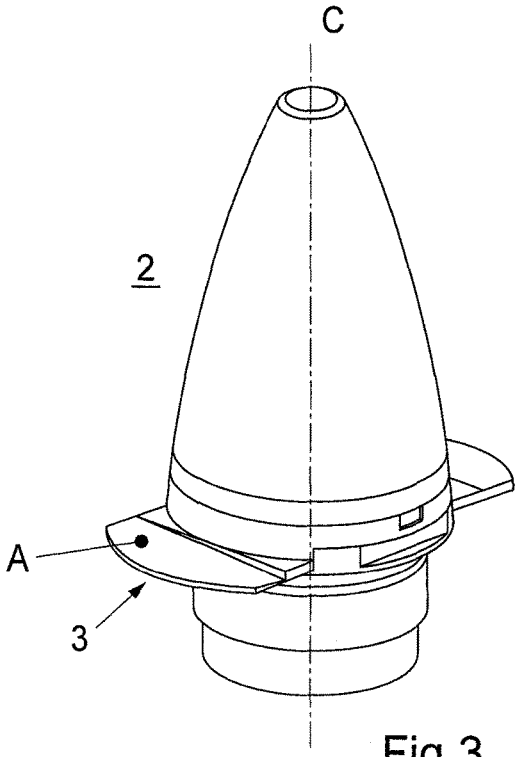
FIG. 3 shows a detonator in a first embodiment with chamfered brake panels in the retracted state according to the invention.

In FIG. 3 is shown a detonator 2 with extended obliquely bevelled brake panels 3. Should the brake panels be obliquely bevelled, the whole or parts of the top side A of the brake panel, that is to say the side which is directed in the direction of travel, is/are chamfered or otherwise machined in order to obtain a surface inclined in the direction of travel, the angulation of whose normal deviates from the centre line C of the projectile.

Figure 4:
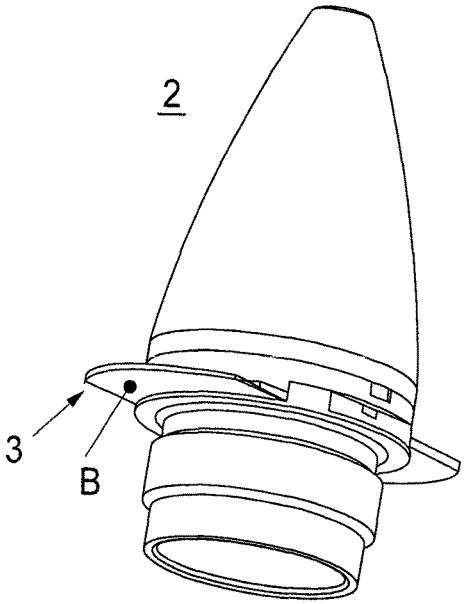
FIG. 4 shows in another view of FIG. 3 a detonator in a first embodiment with chamfered brake panels in the extended state according to the invention.

In FIG. 4 is shown a detonator 2 with extended obliquely bevelled brake panels 3 in a view obliquely from the rear in order to illustrate the embodiment with flat bottom side B. The flatness of the bottom side lends the brake panel 3 improved strength, in addition to which advantages accrue from a simplified production of the brake panel 3 and from a simplified mechanism for controlling the brake panel 3.

Figure 5:
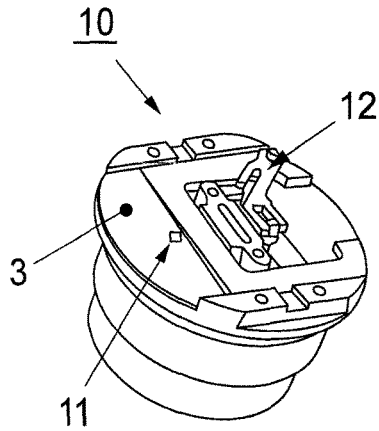
FIG. 5 shows part of a detonator with visible mechanism for the extension of brake panels according to the invention.

In FIG. 5 is shown a preferred mechanical device 10 for extension of the brake panels 3, 3'. The extension mechanism 10 in this embodiment allows only extension of the brake panels 3, 3'. Extension starts through the removal of a mechanically controlled locking pin from a hole 11 in the brake panel 3, 3'. Should a locking pin be placed in the hole 11, the brake panels 3, 3' are held in the retracted state. It is only one locking pin which holds all the brake panels in the retracted state. The extension of the brake panels 3, 3' is coordinated by a mechanical arm 12, which ensures simultaneous extension of all the brake panels 3, 3'. The mechanical arm 12 also ensures locking of the brake panel(s) 3, 3' which is/are not locked by the locking pin in the hole 11. Regardless of which brake panel 3, 3' commences extension, the movement of the brake panels 3, 3', by the mechanical arm 12, will actuate the extension of the other brake panels 3, 3'.

Figure 6:
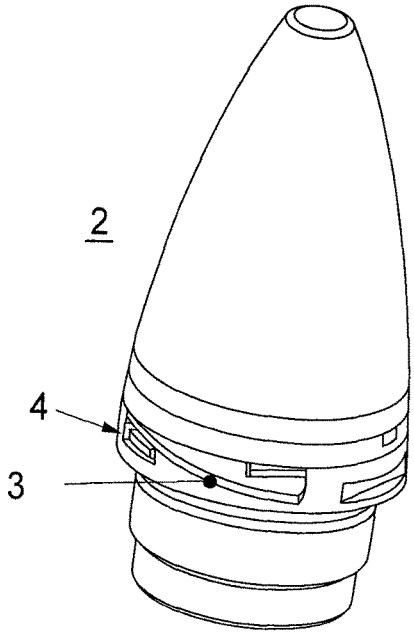
FIG. 6 shows a detonator in a second embodiment with inclined brake panels in the retracted state according to the invention.

In FIG. 6 is shown an alternative embodiment of a detonator 2 prior to extension of inclined brake panels 3'. The detonator 2 is provided with slots 4 for enabling the extension of the brake panels 3'. The activation and extension of the brake panels can be effected by a mechanical, electromechanical, chemical or pyrotechnic device.

Figure 7:
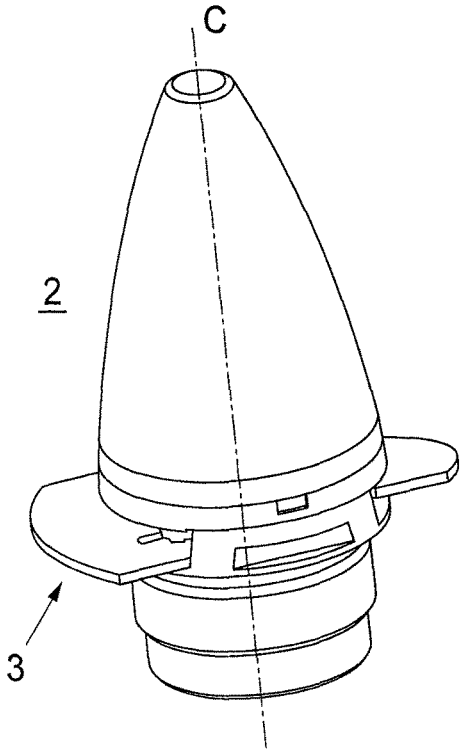
FIG. 7 shows a detonator in a second embodiment with inclined brake panels in the extended state according to the invention.

In FIG. 7 is shown the alternative embodiment of a detonator 2 with extended inclined brake panels 3'. In FIG. 7 it is clear that the brake panel 3' is configured with a uniform material thickness over the surface area of the brake panel 3'.

The brake panels 3, 3' are extended from the detonator 2 or from the projectile 1 in the trajectory of the projectile 1 in order to regulate the range of fire of the projectile. Examples of control of the brake panels 3, 3' can be based on the target of the projectile 1 and/or the position of the projectile 1. The target of the projectile 1 can be programmed or otherwise stored in the projectile 1 prior to launch, but can also be communicated to the projectile 1, with communication equipment such as a radio transmitter, in the trajectory of the projectile between the launcher and the target. The position of the projectile 1 is determined on the basis of a control system mounted in the projectile, which control system obtains the current position from satellite navigation and/or inertial navigation or some other navigation system. The control system continuously evaluates the current position relative to the target position, as well as calculated velocity, in order to control and/or optimize the trajectory of the projectile.

The target of the projectile 1 can also be determined with a target seeker contained in the projectile 1, which identifies a target and guides the projectile 1 towards the target. Apart from the braking capacity which is described here, which results in control in the longitudinal direction, control of the projectile 1 can also comprise control in the lateral direction with customized control elements. In the case of a state expediently determined on the basis of the control system, the mechanical locking pin in the hole 11, which locking pin holds the brake panels in the retracted state, is initiated, whereby the brake panels 3, 3' are released. The brake panels 3, 3' are extended by the rotation force of the projectile or by a spring, or some other elastically deformed and pretensioned manoeuvring device, mounted in the extension mechanism 10.

Following extension of the brake panels 3, 3', the projectile 1 will be braked, with the result that the projectile is controlled in the longitudinal direction. Extension of the brake panels will also actuate rotation of the projectile should the projectile be rotationally stabilized and thus rotatory.

Through angulation of the top side A of the brake panel, the Magnus torque which is traditionally created by the brake panels during extension, as well as once the brake panels are extended, is counteracted, reduced or eliminated. The angulation of the brake panel 3' 3' can be constant, as shown in FIGS. 1-7, but also variable, for dynamic changing of the angulation (not shown in the figure). The angulation is such that the normal from the surfaces A is not parallel with the centre line C of the projectile. The angulation can be realized on the whole or part of the top side A of the brake panel. The rear side B of the brake panel can be flat or angled; should the rear side be flat, the realization of the retraction and extension of the brake panel can be simplified. The top side A of the brake panels 3, 3' can be angled in such a way that the configuration most closely resembles a propeller which increases the rotation of the projectile 1 when the projectile is propelled. The angulation of the top side A of the brake panels 3, 3' can also be realized in such a way that the rotation of the projectile is braked, for example by the angulation being configured as a propeller which brakes the rotation in the course of propulsion. Should the projectile 1 have an even number of brake panels 3, 3', for example two, four, six or eight brake panels 3, 3', the configuration can be such that the different angulations cancel out one another, so that the rotation neither increases nor decreases in dependence on the angulation of the top side A of the brake panels 3, 3'. Regardless of the angulation of the top side A of the brake panels 3, 3', a certain braking force on the rotation of the projectile 1 will be produced upon the extension of the brake panels 3, 3'.

The brake panel 3, 3' is extended radially from the projectile. The extension mechanism, whereof a variant is shown in FIG. 5, can only extend the brake panel 3, 3'. Other mechanisms (not shown here) can extend the brake panel wholly or partially and retract the brake panel wholly or partially.

The brake function is preferably constituted by two brake panels 3, 3' placed oppositely on each side of the projectile 1 or the detonator 2. The brake function can also consist of a plurality of brake panels 3, 3', including of a plurality of brake panels 3, 3' of different size, which are extended at different positions or instants in the trajectory of the projectile 1. One embodiment can be a projectile 1 configured with a detonator 2 comprising four brake panels 3, 3'. Two of the four brake panels 3, 3' are configured with a small surface area, so that a small braking effect is created, and two of the brake panels 3, 3' are configured with a large surface area, so that a large braking effect is created. The relationship between the surface areas of the small brake panel 3, 3' relative to the large brake panel 3, 3' is in the order of magnitude of 5 to 20 times greater than the surface area of the large brake panel 3, 3' relative to the small brake panel 3, 3'. Early in the trajectory, the two small brake panels 3, 3' are extended and affect the velocity of the projectile during the greater part of the trajectory of the projectile, and late in the trajectory the large brake panels 3, 3' are extended in order to control the velocity of the projectile 1 as the projectile 1 approaches the target. The placement of the smaller brake panels 3, 3' can be above the larger brake panels 3, 3', for example, or else the brake panels 3, 3' can be configured evenly distributed around the projectile. Should a plurality of brake panels 3, 3' be used, one, more or all panels can be configured with angulation. Should two small panels and larger panels be used, the two large panels can be flat and the two smaller panels be configured with an angulation in the order of magnitude of 5-15 degrees.

An alternative embodiment (not shown in the figure) of the extension mechanism 10 allows both the extension and retraction of the brake panels 3, 3' to be regulated on the basis of both velocity and level or length. Regulation of retraction and extension is effected by a control system, mounted in the projectile, for creating variable braking effect on the projectile 1 by the braking panels 3, 3' being wholly extended, partially extended, or alternately retracted and extended, from the projectile 1. Through control of the extension mechanism 10, the braking effect can be variably adapted in order to variably control the velocity of the projectile 1.

Alternative Embodiments

The invention is not limited to the embodiments which have specifically been shown, but can be variously varied within the scope of the patent claims.

It will be appreciated, for example, that the number, size, material and shape of the elements and parts which form part of the projectile provided with a brake mechanism are tailored to the projectile types, weapon system and/or other design characteristics which obtain at the time.

It will be appreciated that the above-described projectile embodiments having a longitudinal brake can comprise many different dimensions and projectile types in dependence on the field of application and the barrel width. The above relates, however, to at least the currently most common shell types of between about 25 mm and 200 mm.

The invention claimed is:

1. A brake panel as part of a projectile, which projectile is for firing from a launcher, wherein those surfaces of the brake panel which are facing in the direction of travel of the projectile are angled in such a way that the normal from the said surfaces (A) is not parallel with the centre line (C) of the projectile, and that the rear side of the brake panel, situated opposite to the direction of travel of the projectile, is flatly configured with a normal from the surface having the same angulation as the centre line of the projectile.

2. The brake panel according to claim 1, wherein an angulation of the normal from that surface (A) of the brake panel which is facing in the direction of travel is in the order of magnitude of 1 degree relative to the centre line (C) of the projectile.

3. The brake panel according to claim 2, wherein an angulation of those surfaces (A) of the brake panel which are facing in the direction of travel of the projectile is variably adjustable relative to the centre line (C) of the projectile.

4. The brake panel according to claim 1, wherein an angulation of those surfaces (A) of the brake panel which are facing in the direction of travel of the projectile is variably adjustable relative to the centre line (C) of the projectile.

5. A projectile comprising a detonator having one or more extensible brake panels, which projectile is for firing from a launcher, wherein those surfaces (A) of the brake panel which are facing in the direction of travel of the projectile are angled in such a way that the normal from the said surfaces (A) is not parallel with the centre line (C) of the projectile, and that the rear side of the brake panel, situated opposite to the direction of travel of the projectile, is flatly configured with a normal from the surface having the same angulation as the centre line (C) of the projectile.

6. The projectile comprising a detonator having one or more extensible brake panels according to claim 5 wherein the angulation of the normal from that surface of the brake panel which is facing in the direction of travel is in the order of magnitude of 1 degree relative to the centre line (C) of the projectile.

7. The projectile comprising a detonator having one or more extensible brake panels according to claim 5 wherein the angulation of those surfaces of the brake panel which are facing in the direction of travel of the projectile is variably adjustable relative to the centre line (C) of the projectile.

8. A projectile for firing from a launcher, which projectile comprises one or more extensible brake panels, those surfaces (A) of the brake panels which are facing in the direction of travel of the projectile are angled in such a way that the normal from the said surfaces (A) is not parallel with the centre line (C) of the projectile, and that the rear side of the brake panel, situated opposite to the direction of travel of the projectile, is flatly configured with a normal from the surface having the same angulation as the centre line (C) of the projectile.

9. The projectile according to claim 8, wherein the number of brake panels is two or four or six or eight.

10. The projectile according to claim 9, wherein the brake panel is variably adjustable between the fully extended state and the wholly retracted state.

11. The projectile according to claim 8, wherein the number of brake panels is one or three or five or seven.

12. The projectile according to claim 11, wherein the brake panel is variably adjustable between the fully extended state and the wholly retracted state.

* * * * *